US007470148B1

(12) United States Patent
Su et al.

(10) Patent No.: US 7,470,148 B1
(45) Date of Patent: Dec. 30, 2008

(54) USB BLUETOOTH CONNECTOR

(75) Inventors: Tai-Yuan Su, Tu-Cheng (TW); Yung-Tsung Yi, Tu-Cheng (TW); Di-Chun Chang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/826,549

(22) Filed: Jul. 17, 2007

(51) Int. Cl.
*H01R 13/648* (2006.01)

(52) U.S. Cl. ..... 439/607

(58) Field of Classification Search ..... 439/1, 439/607–610, 640, 11, 13, 131, 528; 361/760, 361/748, 761; 235/380, 441, 451
See application file for complete search history.

(56) References Cited

U.S. PATENT DOCUMENTS 6,612,874 B1 * 9/2003 Stout et al. ..... 439/640
2006/0208066 A1 * 9/2006 Finn et al. ..... 235/380
2007/0243723 A1 * 10/2007 Liao ..... 439/1

* cited by examiner

*Primary Examiner*—Edwin A. Leon
(74) *Attorney, Agent, or Firm*—Rosenberg, Klein & Lee

(57) ABSTRACT

A USB bluetooth connector includes a shell that includes a front shell whose front and rear communicating with outside and a back shell integrated with the rear of the front shell. A printed circuit module received in the shell has a printed circuit board and a chipset disposed on the printed circuit board. The front of the printed circuit board has electric modules accommodated in the front shell for electrically connecting with corresponding conductors received in a USB interface. And an antenna circuit is etched on the inner surface of the shell and connects with the printed circuit module.

20 Claims, 4 Drawing Sheets

USB BLUETOOTH CONNECTOR

BACKGROUND OF THE INVENTION

1. Field of the Invention

The present invention relates to a bluetooth connector, and more particularly to a USB bluetooth connector for wireless communicating with electronic information appliances which have USB interfaces.

2. The Related Art

In order to solve a problem that too many connecting cables are required for a connection among movable devices, such as mobile phones, PDAs and personal computers etc., a bluetooth technology has developed. The bluetooth technology allows direct radio communication among devices without passing through a remote base station when inter-device data transmission is required at home or office, so that data can be freely transmitted at high speed without any standby time, while causing no communication load to the base station. Also, the inconvenience that an average consumer should connect and maintain communication cables one by one in the house is solved, and integration is promoted among information devices, such as a computer, and communication devices, such as a telephone.

A conventional USB bluetooth connector is used to increase a bluetooth function in an electronic information device which has a USB interface. The conventional USB bluetooth connector includes an insulating housing receiving a plurality of terminals therein, a printed circuit board connecting with the terminals and fabricated in the insulating housing, and an antenna module for sending or receiving signals among electronic information devices disposed in the insulating housing. However, the conventional USB bluetooth connector is too big to conveniently use or carry, especially used in a notebook computer. When the conventional USB bluetooth connector is used in the notebook computer, the USB bluetooth connector exposes out of the notebook computer too much, so the USB bluetooth connector needs to plug in or pull out of the notebook computer frequently, reducing the using life of the USB bluetooth connector. Hence, a compact USB bluetooth connector is desired to overcome the shortcoming described above.

SUMMARY OF THE INVENTION

Accordingly, an object of the present invention is to provide a compact USB bluetooth connector for wireless communicating with electronic devices which have USB interfaces. The USB bluetooth connector includes a shell that has a front shell with a front and a rear thereof communicating with outside and a back shell integrated with the rear of the front shell. A printed circuit module received in the shell has a printed circuit board and a chipset disposed on the printed circuit board. The front of the printed circuit board has electric modules accommodated in the front shell for electrically connecting with corresponding conductors received in the USB interface. And an antenna circuit is etched on the inner surface of the shell and connects with the printed circuit module.

As described above, the electric modules of the printed circuit module are directly received in the front shell to electrically connect with the USB interface, reducing the volume of the USB bluetooth connector, and further more, the antenna circuit is etched on the inner surface of the shell in stead of conventional antenna to reduce the volume of the USB bluetooth connector to least. Therefore, the USB bluetooth connector is enough compact to be inserted in the electronic device all the way and avoid plugging in or pulling out of the electronic device frequently.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
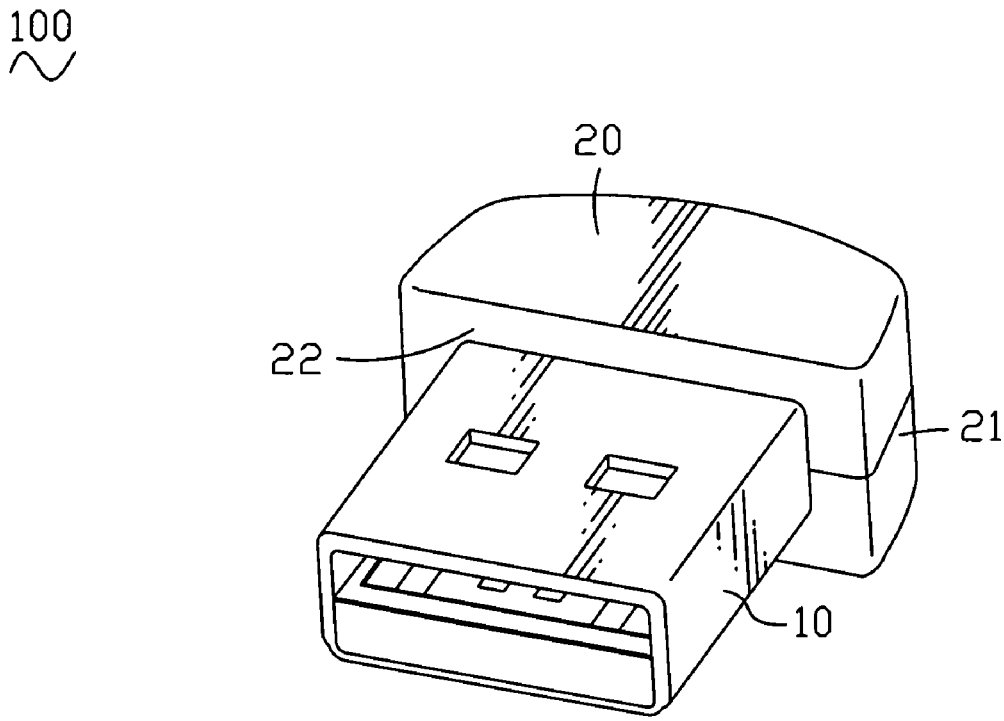
FIG. 1 is a perspective view of a USB bluetooth connector in accordance with the present invention.
Figure 2:
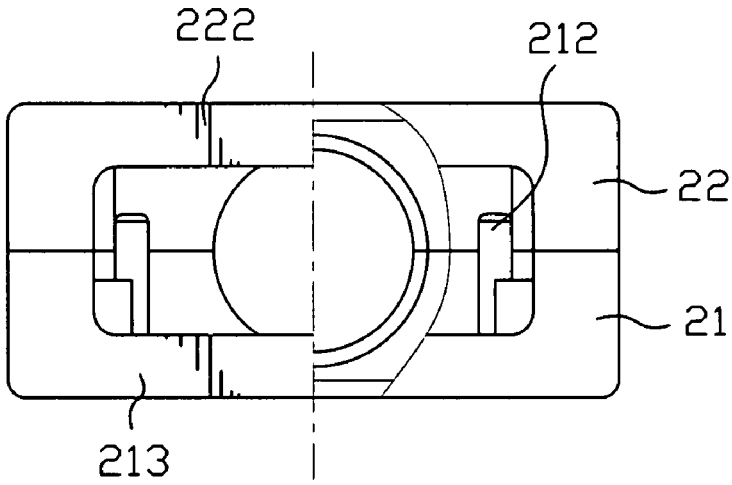
FIG. 2 is a cross-sectional view of a back shell of the USB bluetooth connector.
Figure 3:
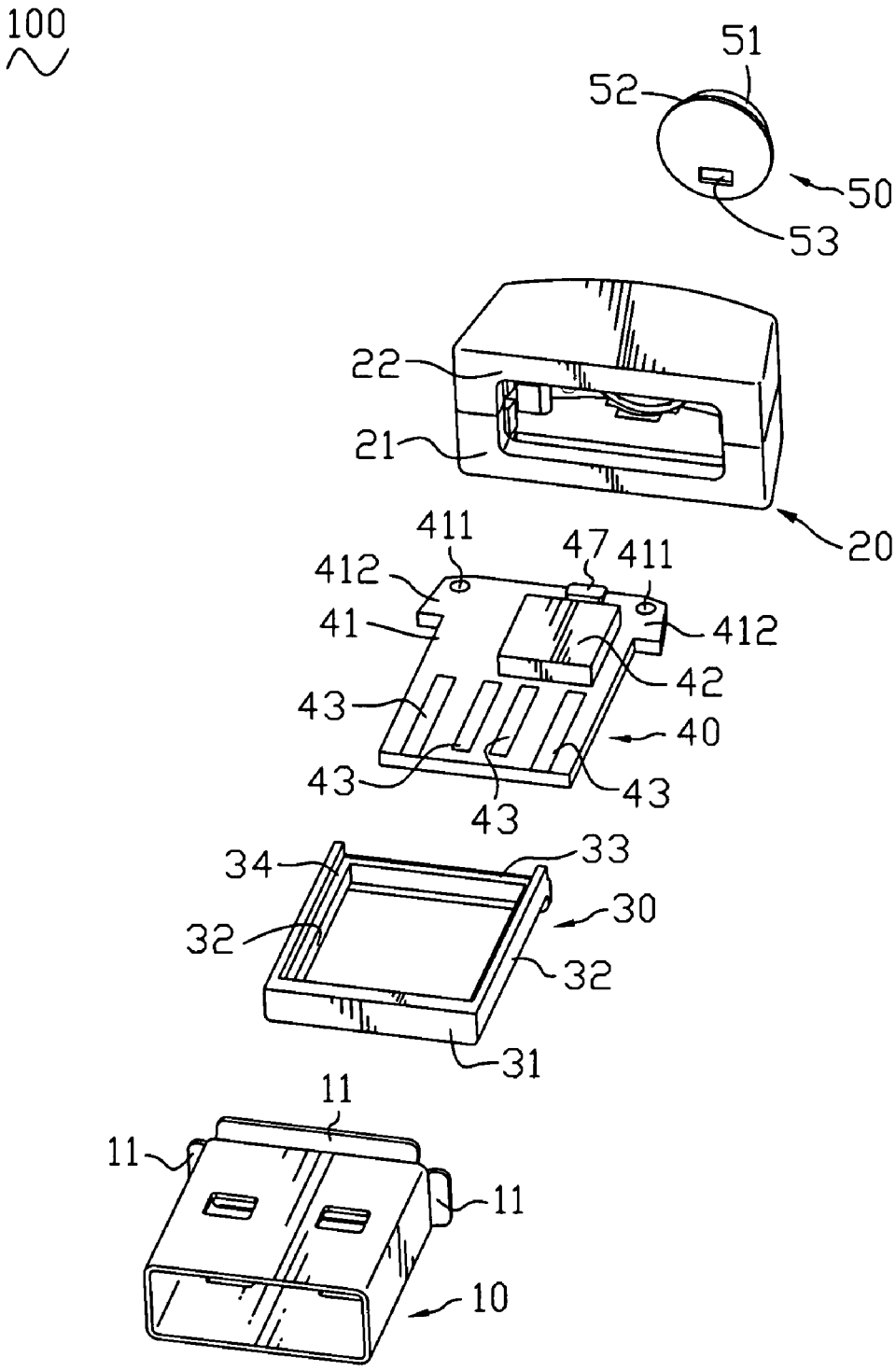
FIG. 3 is an exploded view of the USB bluetooth connector.

Referring to FIG. 1 and FIG. 3, a USB bluetooth connector 100 in accordance with the present invention includes a front shell 10, a back shell 20 integrated with the front shell 10, a bracket 30 received in the front shell 10, a printed circuit module 40 supported by the bracket 30 and the back shell 20, and a button 50 fabricated at a rear of the back shell 20.

Please refer to FIG. 1 and FIG. 3 again. The front shell 10 is in rectangular cannular shape with a front and a rear thereof communicating with outside respectively. The dimension of the front shell 10 mates with a USB interface. Rear edges of the front shell 10 bend outward to form four reverses 11.

With reference to FIGS. 2-5, the back shell 20 is made up of an upper cover 22 and a lower cover 21. The upper cover 22 and the lower cover 21 have a board-shaped front wall 222, 213 defining a front mouth 223, 214 thereon respectively to receive the rear of the front shell 10, and a back wall 226, 217 which smoothly gather backward from bilateral sidewalls of the upper cover 22 and the lower cover 21. The upper cover 22 and the lower cover 21 respectively define a receiving slot 224, 215 in bottom thereof and the receiving slots 224, 215 are adjacent to the front walls 222,213. The bilateral sidewalls of the upper cover 22 and the lower cover 21 define a sub-receiving slot 225, 216 respectively which are on the same line as the receiving slot 224, 215. The receiving slots 224, 215 and the sub-receiving slots 225, 216 accommodate the reverses 11 of the front shell 10 to locate the front shell 10 in the back shell 20. The back walls 226, 217 define a semicircle mounting opening 227, 218 respectively at center thereof for disposing the button 50. The bottom of the lower cover 21 protrudes upward to form two pairs of supporting members 211 at front and back thereof. Each pair of the supporting members 211 is distributed at a lateral side of the lower cover 21. The supporting members 211 connect with the bilateral sidewalls respectively. The supporting members 211 which are in the front of the lower cover 21 are behind the sub-receiving slots 216. Two circular locating pillars 212 protrude upward from the bottom of the lower cover 21 and integrate with the supporting members 211 which are in the back of the lower cover 21 respectively. The bilateral sidewalls of the upper cover 22 protrude inward to define two pairs of retaining members 221 at front and back to mate with the supporting members 211 of the lower cover 21. The two retaining members 221 which are in the front of the upper cover 22 are behind the sub-receiving slots 225.

Please refer to FIG. 3 as well as FIG. 1. The bracket 30 received in the front shell 10 has four fender walls designated a front fender wall 31, bilateral side fender walls 32 and a back fender wall 33, and each two adjacent fender walls connect to each other to form a rectangular frame. The out edges of the top surfaces of the front fender wall 31 and the bilateral side fender walls 32 extend upward, forming a limiting groove 34 therebetween, and the inner edges of the top surfaces of the front fender wall 31 and the bilateral side fender walls 32 as well as the back wall 33 support the printed circuit module 40.

The printed circuit module 40 includes a printed circuit board 41 and a chipset 42 disposed on the printed circuit board 41. The printed circuit board 41 is in rectangular flat-board shape. A rear end of the printed circuit board 41 extends outward to form two shoulders 412. Every shoulder 412 defines a locating hole 411 at a rear corner thereof. The front of the printed circuit board 41 mounts electric modules 43 which are bare welding layers in order to electrically connect with corresponding conductors received in the USB interface. The front of the printed circuit board 41 is supported by the bracket 30 and is received in the front shell 10. The shoulders 412 are received in the back shell 20 and located between the supporting members 211 and the retaining members 221 with the locating pillars 212 inserted in the locating holes 411 respectively.

Figure 4:
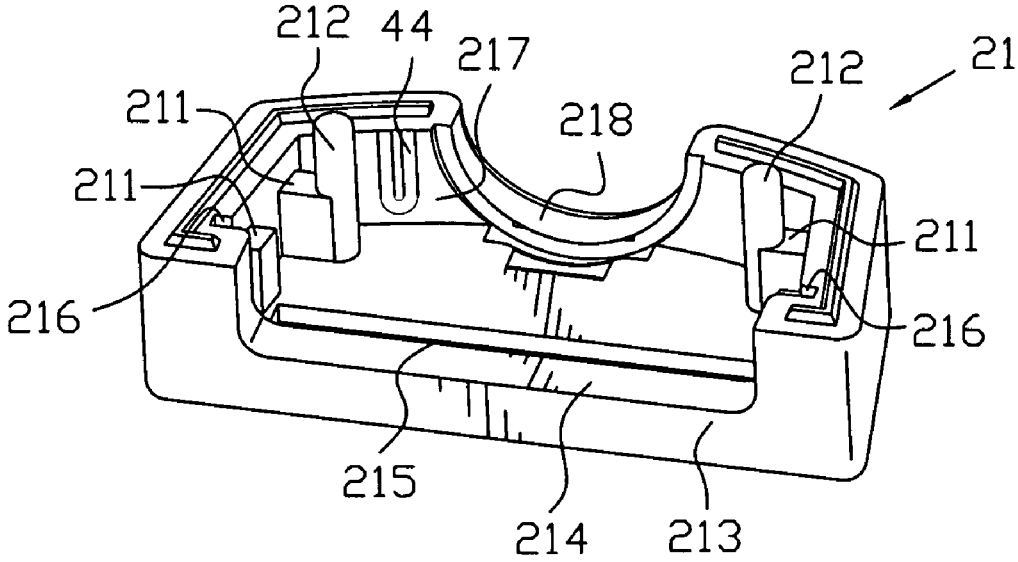
FIG. 4 is a perspective view of a lower cover of the back shell.
Figure 5:
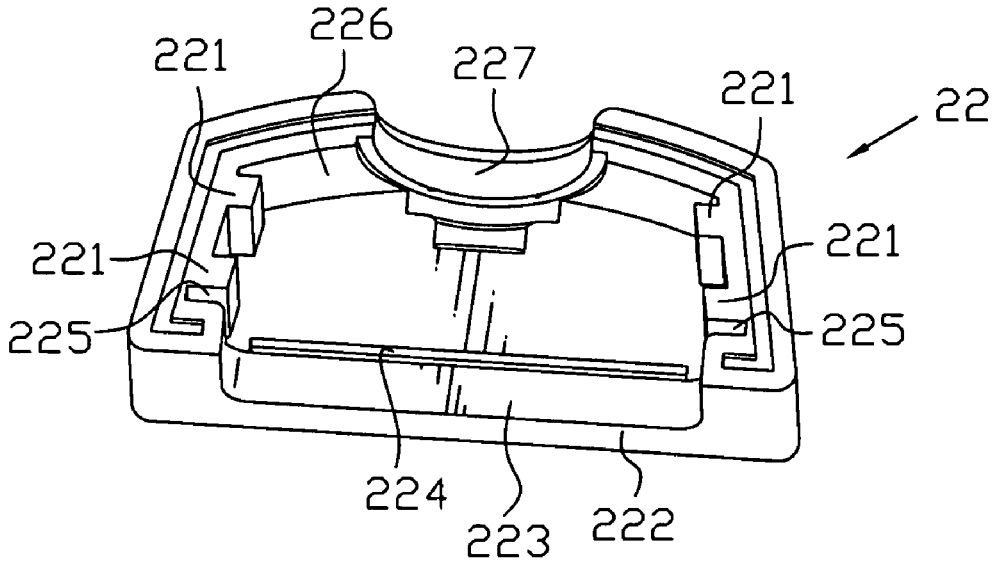
FIG. 5 is a perspective view of an upper cover of the back shell.

Referring to FIG. 4, the inner surface of the back wall 217 of the lower cover 21 is plated with a VM layer, and then etching an antenna circuit 44 which includes a connection end on the VM layer through a method of laser. Then the principal part of the antenna is constructed. Afterwards, the antenna circuit 44 is plated with a UV layer except the connection end. The connection end of the antenna circuit 44 is connected to the printed circuit module 40. Besides the antenna circuit 44 etched on the inner surface of the back shell 20, the antenna circuit 44 can be etched on the printed circuit board 41 of the printed circuit module 40.

Figure 6:
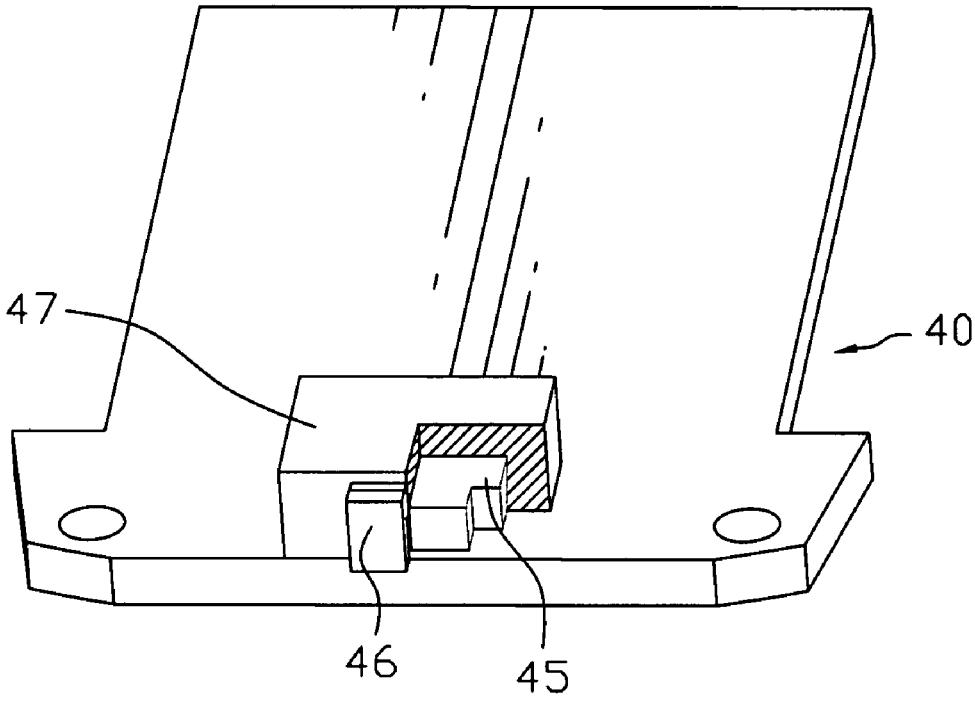
FIG. 6 is a perspective view of a printed circuit board of the USB bluetooth connector, especially showing a LED and a pressing switch which are disposed thereon.

Referring to FIG. 6, the printed circuit board 41 disposes a LED 45 for showing the work state of the USB bluetooth connector 100. A holding frame 47 which mounts the LED 45 is defined behind the chipset 42. A pressing switch 46 used to control the USB bluetooth connector 100 to work is arranged at the rear of the printed circuit board 41 and connects with the holding frame 47. The holding frame 47 is made of transparent material.

Referring to FIG. 3, the button 50 includes a cylinder-shaped pressing portion 51. A flange 52 is formed from the outside of the inner circle of the pressing portion 51. The front surface of the pressing portion 51 defines a buckle groove 53 to be located on the pressing switch 46 of the printed circuit module 40. The button 50 is made of transparent material and is assembled on the mounting opening 227, 218 of the back shell 20. So the mounting openings 227, 218 are pervious to light.

As described above, the electric modules 43 of the printed circuit module 40 is directly received in the front shell 10 to electrically connect with the USB interface, reducing the volume of the USB bluetooth connector 100, and further more, the antenna circuit 44 is etched on the inner surface of the back shell 20 in stead of conventional antenna to reduce the volume of the USB bluetooth connector 100 to least. What is more, the back shell 20 has board-shaped front walls 222, 213, so the USB bluetooth connector 100 can stay close to an electronic device when the front shell 10 is inserted in a USB interface of the electronic device. Because the back walls 226, 217 of the back shell 20 smoothly gather backward from the bilateral sidewalls thereof, the design disperses the act force on the USB bluetooth connector 100 and reduces the collision force acting on the USB bluetooth connector 100. Therefore, the USB bluetooth connector 100 can be inserted in the electronic device all the way and avoid plugging in or pulling out of the electronic device frequently.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A USB bluetooth connector, comprising:

a shell, including a front shell with a front and a rear thereof communicating with outside, and a back shell, wherein the back shell defines two receiving slots in bottoms thereof and two sub-receiving slots in bilateral sidewalls thereof, the rear edges of the front shell bend outward to form four reverses, the reverses are received in the receiving slots and the sub-receiving slots of the back shell so that the back shell is integrated with the rear of the front shell;

a printed circuit module, received in the shell and having a printed circuit board and a chipset disposed on the printed circuit board, the front of the printed circuit board having electric modules accommodated in the front shell for electrically connecting with corresponding conductors received in a USB interface; and an antenna circuit, etched on an inner surface of the shell and connecting with the printed circuit module.

2. The USB bluetooth connector as claimed in claim 1, wherein the electric modules are bare welding layers.

3. The USB bluetooth connector as claimed in claim 1, wherein the back shell includes an upper cover and a lower cover, the bottom of the lower cover protrudes upward to form two pairs of supporting members at front and back thereof, each pair of the supporting members is distributed at a lateral side of the lower cover, two circular locating pillars protrude upward from the bottom of the lower cover and integrate with the supporting members which are in the back of the lower cover respectively, bilateral sidewalls of the upper cover protrude inward to define two pairs of retaining members at front and back to mate with the supporting members respectively, wherein the rear end of the printed circuit board extends outward to form two shoulders, every shoulder defines a locating hole at a rear corner thereof, the shoulders are received in the back shell and located between the supporting members and the retaining members with the locating pillars inserted in the locating holes respectively, the front of the printed circuit board is received in the front shell.

4. The USB bluetooth connector as claimed in claim 1, further comprising a bracket received in the front shell having four fender walls designated a front fender wall, bilateral side fender walls and a back fender wall, each two adjacent fender walls connecting to each other to form a rectangular frame, the out edges of the top surfaces of the front fender wall and the bilateral side fender walls extending upward, forming a limiting groove therebetween, and the inner edges of the top surfaces of the front fender wall and the bilateral side fender walls as well as the back wall supporting the front of the printed circuit board.

5. The USB bluetooth connector as claimed in claim 1, wherein the printed circuit board disposes a LED for showing the work state of the USB bluetooth connector, a holding frame which mounts the LED is defined behind the chipset.

6. The USB bluetooth connector as claimed in claim 5, wherein the printed circuit module includes a pressing switch arranged at the rear of the printed circuit board and connected with the holding frame to control the USB bluetooth connector to work, the back shell defines a mounting opening at rear thereof to assemble a button, and the button is fabricated with the pressing switch.

7. The USB bluetooth connector as claimed in claim 6, wherein the button includes a cylinder-shaped pressing portion, a flange is formed from the outside of the inner circle of the pressing portion, the front surface of the pressing portion defines a buckle groove to be located on the pressing switch.

8. The USB bluetooth connector as claimed in claim 6, wherein the holding frame and the button are made of transparent material.

9. The USB bluetooth connector as claimed in claim 1, wherein the inner surface of the back shell is plated with a VM layer, and then etching the antenna circuit that includes a connection end on the VM layer, afterwards, the antenna circuit is plated with a UV layer except the connection end, the connection end of the antenna circuit is connected to the printed circuit module.

10. The USB bluetooth connector as claimed in claim 9, wherein the antenna circuit is etched on the VM layer through a method of laser.

11. A USB bluetooth connector, comprising:

a shell, including a front shell with a front and a rear thereof communicating with outside, and a back shell integrated with the rear of the front shell, the back shell includes an upper cover and a lower cover, the bottom of the lower cover protruding upward to form at least two supporting members respectively located at two sides thereof, bilateral sidewalls of the upper cover protruding inward to define at least two retaining members to mate with the supporting members respectively;

a printed circuit module, received in the shell and having a printed circuit board and a chipset disposed on the printed circuit board, the front of the printed circuit board having electric modules accommodated in the front shell for electrically connecting with corresponding conductors received in a USB interface, the rear end of the printed circuit board extending outward to form two shoulders, the shoulders are received in the back shell and located between the supporting members and the retaining members, the front of the printed circuit board is received in the front shell; and an antenna circuit, etched on an inner surface of the shell and connecting with the printed circuit module.

12. The USB bluetooth connector as claimed in claim 11, wherein two locating pillars protrude upward from the bottom of the lower cover and integrate with the supporting members respectively, every shoulder defines a locating hole at a rear corner thereof for accommodating the locating pillar.

13. The USB bluetooth connector as claimed in claim 11, wherein the back shell defines two receiving slots in bottoms thereof and two sub-receiving slots in bilateral sidewalls thereof, wherein the rear edges of the front shell bend outward to form four reverses, the reverses are received in the receiving slots and the sub-receiving slots of the back shell.

14. The USB bluetooth connector as claimed in claim 11, further comprising a bracket received in the front shell having four fender walls designated a front fender wall, bilateral side fender walls and a back fender wall, each two adjacent fender walls connecting to each other to form a rectangular frame, the out edges of the top surfaces of the front fender wall and the bilateral side fender walls extending upward, forming a limiting groove therebetween, and the inner edges of the top surfaces of the front fender wall and the bilateral side fender walls as well as the back wall supporting the front of the printed circuit board.

15. The USB bluetooth connector as claimed in claim 11, wherein the inner surface of the back shell is plated with a VM layer, and then etching the antenna circuit that includes a connection end on the VM layer, afterwards, the antenna circuit is plated with a UV layer except the connection end, the connection end of the antenna circuit is connected to the printed circuit module.

16. A USB bluetooth connector, comprising:

a shell, including a front shell with a front and a rear thereof communicating with outside, and a back shell integrated with the rear of the front shell;

a printed circuit module, received in the shell and having a printed circuit board and a chipset disposed on the printed circuit board, the front of the printed circuit board having electric modules accommodated in the front shell for electrically connecting with corresponding conductors received in a USB interface;

a bracket received in the front shell, the front of the printed circuit board supported by the bracket; and an antenna circuit, etched on an inner surface of the shell and connecting with the printed circuit module.

17. The USB bluetooth connector as claimed in claim 16, wherein the bracket has four fender walls designated a front fender wall, bilateral side fender walls and a back fender wall, each two adjacent fender walls connect to each other to form a rectangular frame, the out edges of the top surfaces of the front fender wall and the bilateral side fender walls extend upward, forming a limiting groove therebetween, and the inner edges of the top surfaces of the front fender wall and the bilateral side fender walls as well as the back wall support the front of the printed circuit board.

18. The USB bluetooth connector as claimed in claim 16, wherein the back shell defines two receiving slots in bottoms thereof and two sub-receiving slots in bilateral sidewalls thereof, wherein the rear edges of the front shell bend outward to form four reverses, the reverses are received in the receiving slots and the sub-receiving slots of the back shell.

19. The USB bluetooth connector as claimed in claim 16, wherein the back shell includes an upper cover and a lower cover, the bottom of the lower cover protrudes upward to form two pairs of supporting members at front and back thereof, each pair of the supporting members is distributed at a lateral side of the lower cover, two circular locating pillars protrude upward from the bottom of the lower cover and integrate with the supporting members which are in the back of the lower cover respectively, bilateral sidewalls of the upper cover protrude inward to define two pairs of retaining members at front and back to mate with the supporting members respectively, wherein the rear end of the printed circuit board extends outward to form two shoulders, every shoulder defines a locating hole at a rear corner thereof, the shoulders are received in the back shell and located between the supporting members and the retaining members with the locating pillars inserted in the locating holes respectively, the front of the printed circuit board is received in the front shell.

20. The USB bluetooth connector as claimed in claim 16, wherein the inner surface of the back shell is plated with a VM layer, and then etching the antenna circuit that includes a connection end on the VM layer, afterwards, the antenna circuit is plated with a UV layer except the connection end, the connection end of the antenna circuit is connected to the printed circuit module.

* * * * *